US007134762B2

(12) United States Patent
Ma

(10) Patent No.: US 7,134,762 B2
(45) Date of Patent: Nov. 14, 2006

(54) LIGHT PROVIDING APPARATUS ATTACHABLE TO UMBRELLA AND STAND ASSEMBLY

(76) Inventor: Oliver Joen-An Ma, 29 W. Wistaria Ave., Arcadia, CA (US) 91006

( * ) Notice: Subject to any disclaimer, the term of this patent is extended or adjusted under 35 U.S.C. 154(b) by 49 days.

(21) Appl. No.: 10/715,096

(22) Filed: Nov. 18, 2003

(65) Prior Publication Data

US 2005/0117326 A1 Jun. 2, 2005

(51) Int. Cl.
*A45B 3/02* (2006.01)
*F21S 13/10* (2006.01)

(52) U.S. Cl. ..... 362/102; 362/431; 362/396; 362/577; 135/910

(58) Field of Classification Search ..... 362/102, 362/431, 577, 183, 523, 173, 20, 396, 367, 362/365, 581, 543, 249, 436, 438, 450, 352; 135/910

See application file for complete search history.

(56) References Cited

U.S. PATENT DOCUMENTS 4,020,858 A 5/1977 Wilson
4,174,532 A 11/1979 Kelley
4,225,909 A * 9/1980 Scholz et al. ..... 362/367
4,425,602 A 1/1984 Lansing
4,601,120 A 7/1986 Levin
4,787,019 A * 11/1988 van den Broeke ..... 362/250
4,788,995 A 12/1988 Rushing
4,867,187 A 9/1989 Divine
4,872,468 A 10/1989 Cole
4,881,154 A 11/1989 Tseng et al.
4,953,839 A * 9/1990 Chern ..... 269/73
4,962,779 A 10/1990 Meng
5,007,811 A * 4/1991 Hopkins ..... 135/16
5,055,984 A * 10/1991 Hung et al. ..... 362/183
5,126,922 A 6/1992 Andreasen
5,152,495 A 10/1992 Jacinto et al.
5,213,122 A 5/1993 Grady, II
5,280,799 A 1/1994 Alajajian
5,291,908 A 3/1994 Grady, II
5,323,798 A 6/1994 Yang
5,349,975 A 9/1994 Valdner
5,449,012 A 9/1995 Friedman
5,502,624 A 3/1996 Tu
5,584,564 A * 12/1996 Phyle ..... 362/102
5,611,614 A 3/1997 Morgan
5,707,135 A 1/1998 Miller, Jr.
5,816,685 A 10/1998 Hou (Continued)

FOREIGN PATENT DOCUMENTS

DE 9319387 7/1994

(Continued)

OTHER PUBLICATIONS

European Search Report, dated Dec. 22, 2005 regarding Application No. EP 05 01 9669.

(Continued)

*Primary Examiner*—John Anthony Ward
*Assistant Examiner*—Bao Q. Truong
(74) *Attorney, Agent, or Firm*—Knobbe, Martens, Olson &Bear

(57) ABSTRACT

A light provider for an umbrella and stand assembly, including a body releasably attachable to the assembly, a source or sources of electric light carried by the body, to direct light away from the body, and incident light responsive means on the body to provide electrical energization for the light source, the means configured to receive incident light from a direction or directions spaced away from light directed from the source or sources.

44 Claims, 11 Drawing Sheets

U.S. PATENT DOCUMENTS

| | | | | |
|---|---|---|---|---|
| 5,954,417 | A | | 9/1999 | Mai |
| 5,960,805 | A | | 10/1999 | Murphy |
| 6,013,985 | A | * | 1/2000 | Green et al. ..... 315/149 |
| 6,024,464 | A | | 2/2000 | De Vera |
| 6,086,006 | A | | 7/2000 | Scerbvo, III |
| 6,126,291 | A | | 10/2000 | Chung-Kuang et al. |
| 6,135,605 | A | | 10/2000 | Hsu et al. |
| 6,158,451 | A | | 12/2000 | Wu |
| 6,270,230 | B1 | | 8/2001 | Mai |
| 6,283,610 | B1 | | 9/2001 | Alajajian |
| 6,382,809 | B1 | | 5/2002 | Ou-Yang |
| 6,659,616 | B1 | | 12/2003 | Bilotti |
| 6,837,255 | B1 | | 1/2005 | Bunch et al. |
| 6,851,823 | B1 | | 2/2005 | Bilotti |
| 2004/0007259 | A1 | | 1/2004 | Manolis |
| 2004/0031513 | A1 | | 2/2004 | Bunch et al. |
| 2004/0055627 | A1 | | 3/2004 | Moga |
| 2004/0095749 | A1 | | 5/2004 | Bilotti |
| 2004/0100791 | A1 | | 5/2004 | Bilotti et al. |

FOREIGN PATENT DOCUMENTS

| | | |
|---|---|---|
| GB | 2396205 | 6/2004 |
| WO | WO 90/96069 | 6/1990 |
| WO | WO 93/05688 | 4/1993 |
| WO | WO 98/49915 | 11/1998 |
| WO | WO 00/13541 | 3/2000 |
| WO | WO 02/69751 | 3/2002 |
| WO | WO 03/092428 | 4/2003 |

OTHER PUBLICATIONS

US 5,865,202, 02/1999, Murphy (withdrawn)

* cited by examiner

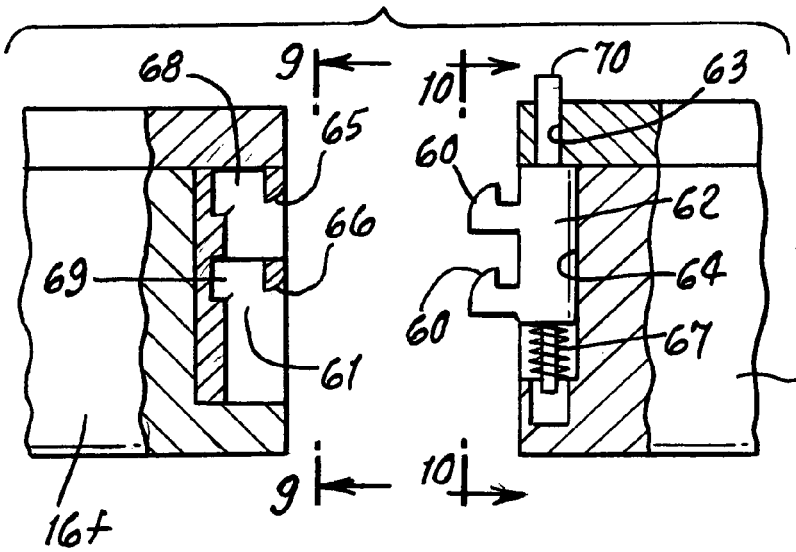
FIG. 7.
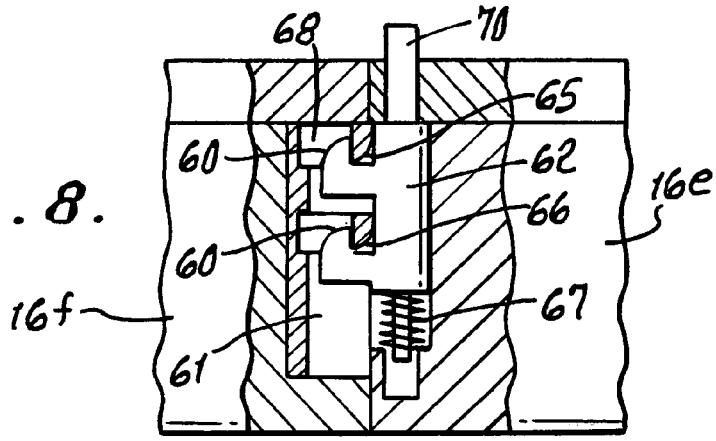
FIG. 8.
FIG. 9.
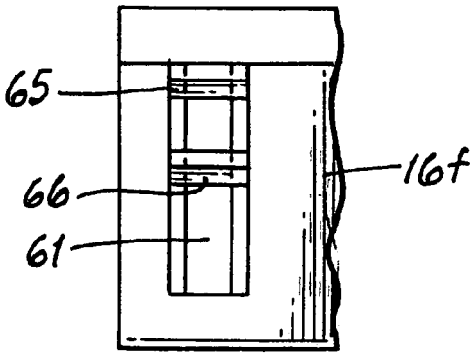
FIG. 10.
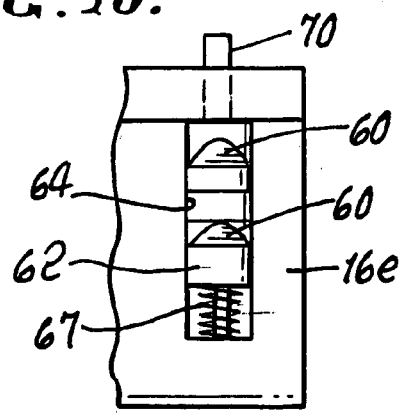

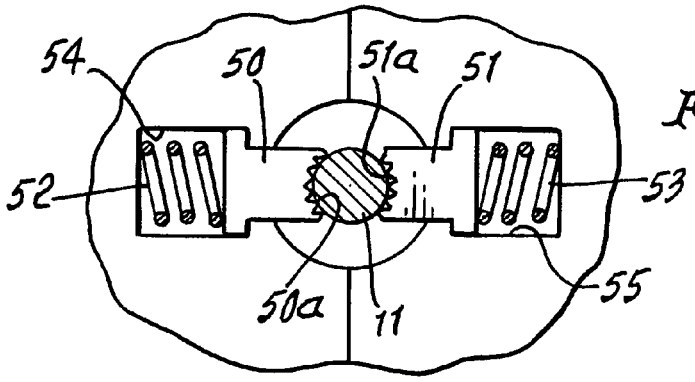
FIG. 11.
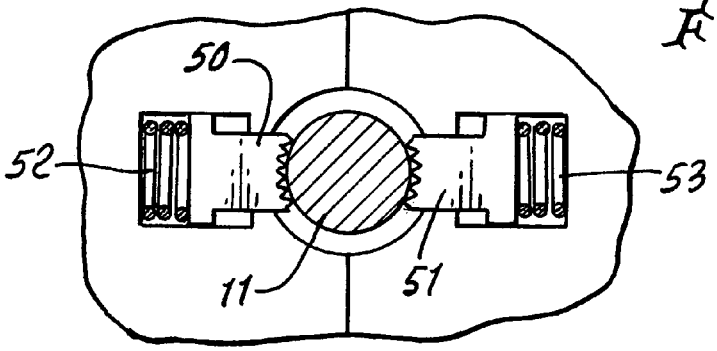
FIG. 12.
FIG. 13.
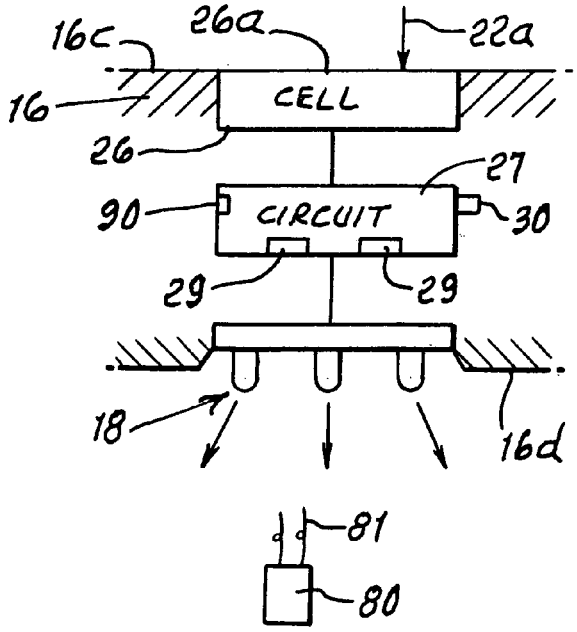
FIG. 14.
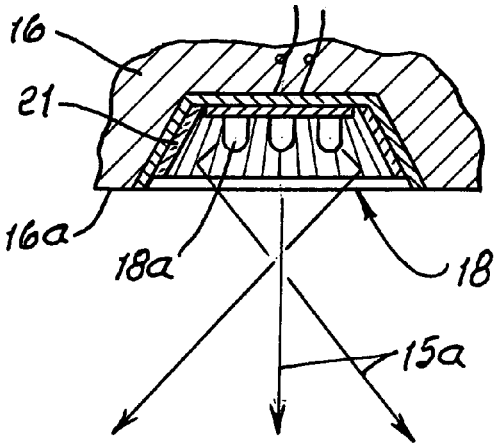

LIGHT PROVIDING APPARATUS ATTACHABLE TO UMBRELLA AND STAND ASSEMBLY

BACKGROUND OF THE INVENTION

This invention relates generally to light transmission from an umbrella and stand locations, and more particularly to apparatus attachable to an umbrella stand to achieve such illumination.

It is a common practice for ordinary people to use a garden umbrella in various outdoor resting/dining areas as a means to shade sunlight or to block rain drops when spending their leisure time outdoors. Hence, in this way a comfortable and relaxing environment can be provided. At present, since there is no lighting device specifically designed to be used with a garden umbrella when the surrounding lighting condition becomes dim, and people tend to improvise by attaching a corded lighting device to the umbrella to provide sufficient lighting to adjacent area. Nevertheless, although this type of lighting device is readily available, the disadvantages for using a corded lighting device in this way often poses a hazardous situation to people moving around in this area, because of the dangling electrical cord; and further the hanging electrical cord gives an undesirable contrast to the nature background which can easily ruin the relaxing atmosphere.

There is also need at umbrella and stand locations, such as patios, for controlled illumination, associated with selected individual umbrella locations, instead of general illumination of the entire area. It appears that no way was previously known to achieve these objectives in the novel and unusual manner, and with unusual results, as are now provided by the present invention.

SUMMARY OF THE INVENTION

It is a major object of the invention to provide apparatus and method to meet the above need. Basically, the invention is embodied in a light provider for an umbrella and stand assembly, and that comprises:

a) a body releasably attachable to the assembly, b) a source or sources of electric light carried by the body, to direct such light away from the body, c) and incident light responsive means on the body to provide electrical energization for the light source, said means configured to receive incident light from a direction or directions spaced away from light directed from said source or sources.

As will appear, the carrier body advantageously includes multiple sections that become interconnected when the body is attached to the assembly stand, whereby quick mounting or de-mounting of the light provider is made possible.

It is an objective of the present invention to solve all technical issues to meet the need for the referenced need by providing a portable, multi-purpose lighting device which can be easily fastened to, as well as un-fastened from, a pole-like object such as an umbrella stand, and without the trouble of having an electrical cord hanging undesirably from it.

The present invention achieves desired objectives by providing a multi-purpose lighting device comprising a plurality of base parts, preferably a lighting means integrated to each base part, and a power supply part. The present invention in one form is characterized by two structurally divided base parts A and B, each having a semi-circularly curved inner sidewall surface facing that of the other and in which a circular through hole is formed when the two base parts A and B are joined together. The present invention is further characterized by having a solar power charging part and a grip locking means for gripping to a pole-like structure when said two base parts are coupled together while regulating gripping tension at the same time.

Another object is to provide the incident light responsive means in the form of a solar cell or cells, and said light source or sources comprise an LED or LEDs. The LEDs may be provided in clusters received in light reflecting receptacles, for producing concentrated light beams, the intensity and/or color of which may be controlled.

Another object includes provision of a carrier body central opening to receive the umbrella stand. The body may include multiple sections that become interconnected when said body is attached to the assembly stand. At least two sections may have hinged interconnection, whereby the sections are clampingly connected to the stand.

Additionally, a stand gripper or grippers may be provided at the central opening, and carried by the body; and the two body sections may respectively carry two grippers, with a spring or springs urging at least one gripper toward the other, to grip the stand therebetween. Stands of different diameters can thereby be gripped.

Latch elements may be carried by the body sections to latch together when the sections are closed about an umbrella stand; and a latch release may be provided on one section. The construction enables inverting of the carrier body, to direct light upwardly or downwardly.

Typically, a grip locking means is provided to include a gripping claw, a sliding block, a crank handle, and a transmission part substantially connected to said crank handle; wherein, a slot is integrally formed inside each of the above-mentioned base part for slidably receiving said sliding block. Preferably, the grip locking means further comprises two threaded pillar parts substantially perpendicular to the coupling surface for rotatably driving said sliding block and transmission part. The gripping claw is securely coupled to the sliding block which enables inward or outward sliding movements of the gripping claw along longitudinal direction of said slot. Thus, gripping tension of said gripping claw can be suitably adjusted when gripping to a pole-like object by suitably adjusting the extension of said gripping claw protruding from the slot of said coupling surface.

The solar power charging part comprises a plurality of solar panels formed on a base part, and each solar panel is electrically connected to a solar-charging circuit part in the base part by mans of wires.

The base part preferably includes a circular disk shape, wherein, a circular hole is formed through the center of the base part by having two structurally divided base parts A and B, combined together having a symmetrical semi-circularly curved inner sidewall surface facing that of the other.

The two divided base parts A and B may be hinged together along corner edges while the other corner edges are bound together by means of a separable buckling part, preferably.

The transmission structure may comprise a larger first gear and a pair of smaller second gears both engaging said first gear. The first gear is mounted inside a gear box part by means of an axle part while the second gears drive a threaded pillar part.

The sliding block and the gripping claw may both be of rectangular shape. A curved gripping surface is formed on the gripping claw such that a gripping teeth profile is preferably formed on the curved gripping surface. Furthermore, a longitudinal extending recessing strip formed on each side wall of said slot slidably receives a corresponding longitudinal extending protruding strip formed on each side wall of the sliding block.

The lighting means is preferably a battery-powered high luminance LED lamp. Compared with the prior lighting devices, the present invention has the advantage of comprising a locking means capable of regulating gripping tension of said gripping claw to achieve firm grip to a pole-like object of different circumferential dimensions. Furthermore, the locking means is easy to be positioned, installed and uninstalled.

The present invention has another advantage of using a solar power charging part for charging a rechargeable battery directly which provides a safer and easier use of the device. Additionally, said rechargeable battery part is equipped with a corded charging unit, and the rechargeable battery is preferably concealed inside the base part.

These and other objects and advantages of the invention, as well as the details of an illustrative embodiment, will be more fully understood from the following specification and drawings, in which:

DRAWING DESCRIPTION

FIG. 7 is an elevation taken on lines 7—7 of FIG. 6;

FIG. 8 is a view like FIG. 7, but showing the latch elements in connected condition;

FIG. 9 is an elevation view taken on lines 9—9 of FIG. 7, showing female latching elements;

FIG. 10 is an elevation view taken on lines 10—10 of FIG. 7, showing male latch elements;

FIG. 11 is a fragmentary plan view showing umbrella stand grippers, engaging a stand of lesser diameter;

FIG. 12 is a view like FIG. 11, showing the grippers engaging a stand of relatively larger diameter;

FIG. 13 is a circuit schematic;

FIG. 14 is a section showing LED clustering within a light reflector;

DETAILED DESCRIPTION

Figure 2:
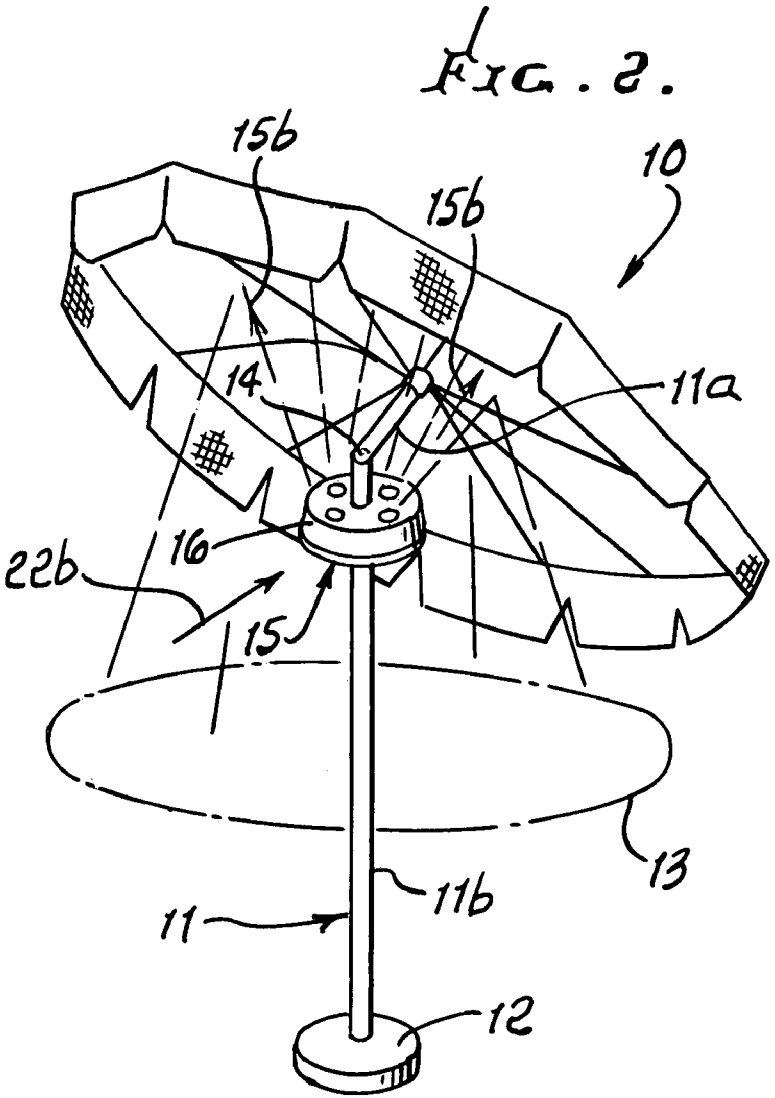
FIG. 2 is a view like FIG. 1, but showing the apparatus of FIG. 1 in inverted position.
Figure 1:
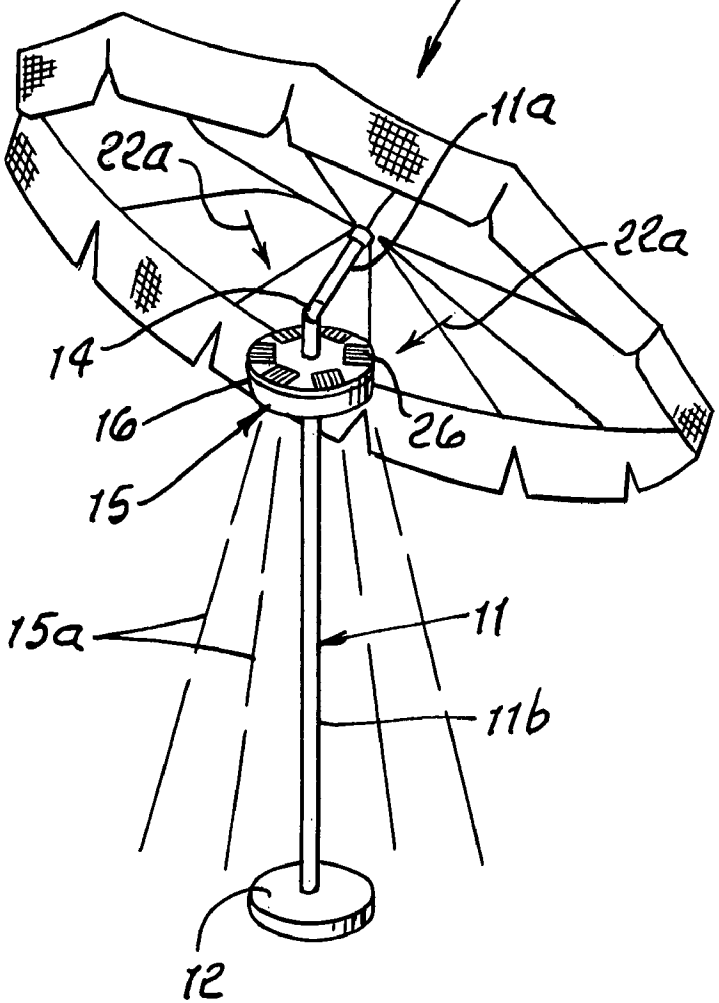
FIG. 1 is an elevation view of light providing apparatus incorporating the invention, supported on an umbrella stand.

In FIGS. 1 and 2, an umbrella 10 is supported in a central stand 11, projecting from a base 12. The stand may or may not have an upper section 11*a* which can be tilted, at joint 14. An optional table is indicated at 13.

Figure 5:
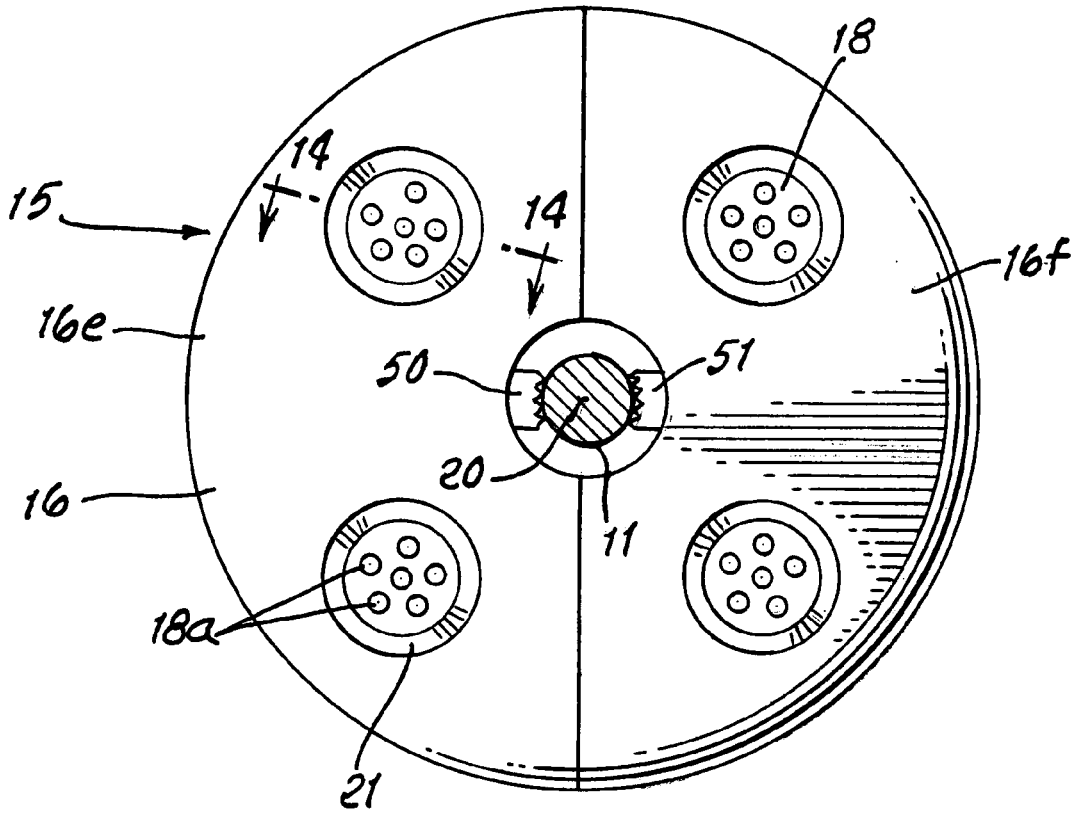
FIG. 5 is an enlarged, bottom plan view of the FIG. 1 apparatus.
Figure 6:
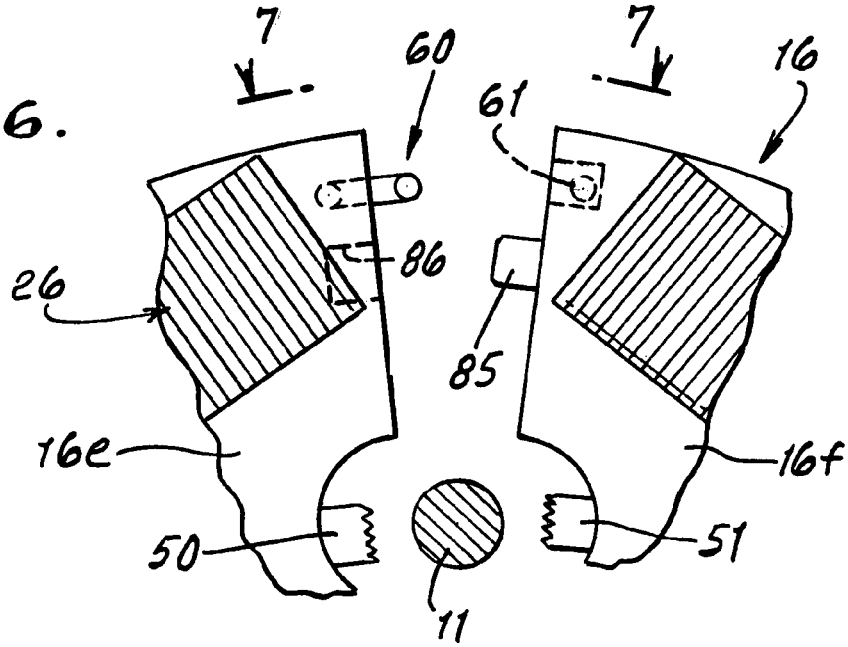
FIG. 6 is a fragmentary view showing the apparatus in disconnected condition, with latch guide elements protruding.

In accordance with the invention, a preferred light provider or fixture 15 is installed in supported position on the stand section 11*b*. In FIG. 1, light beams 15*a* are directed downwardly, away from body 16 of the light provided; and in FIG. 2, light beams 15*b* are directed upwardly away from the inverted body 16. A source or sources 18 of projected light are carried by the body 16, and may comprise clusters 18*a* of LEDs, as shown in FIG. 5. Such clusters are spaced about the stand axis 20; and each cluster may comprise between 2 and 8 LEDs, as shown. Receptacle shaped reflectors 21 re-direct light rays from the LED clusters downwardly in FIG. 1, and upwardly in FIG. 2. See also FIG. 14. The LEDs are protectively received in the receptacles which are sunk into the body 16, from surface 16*a*. Concentrated beams are produced by the multiple clustered LEDs.

Figure 3:
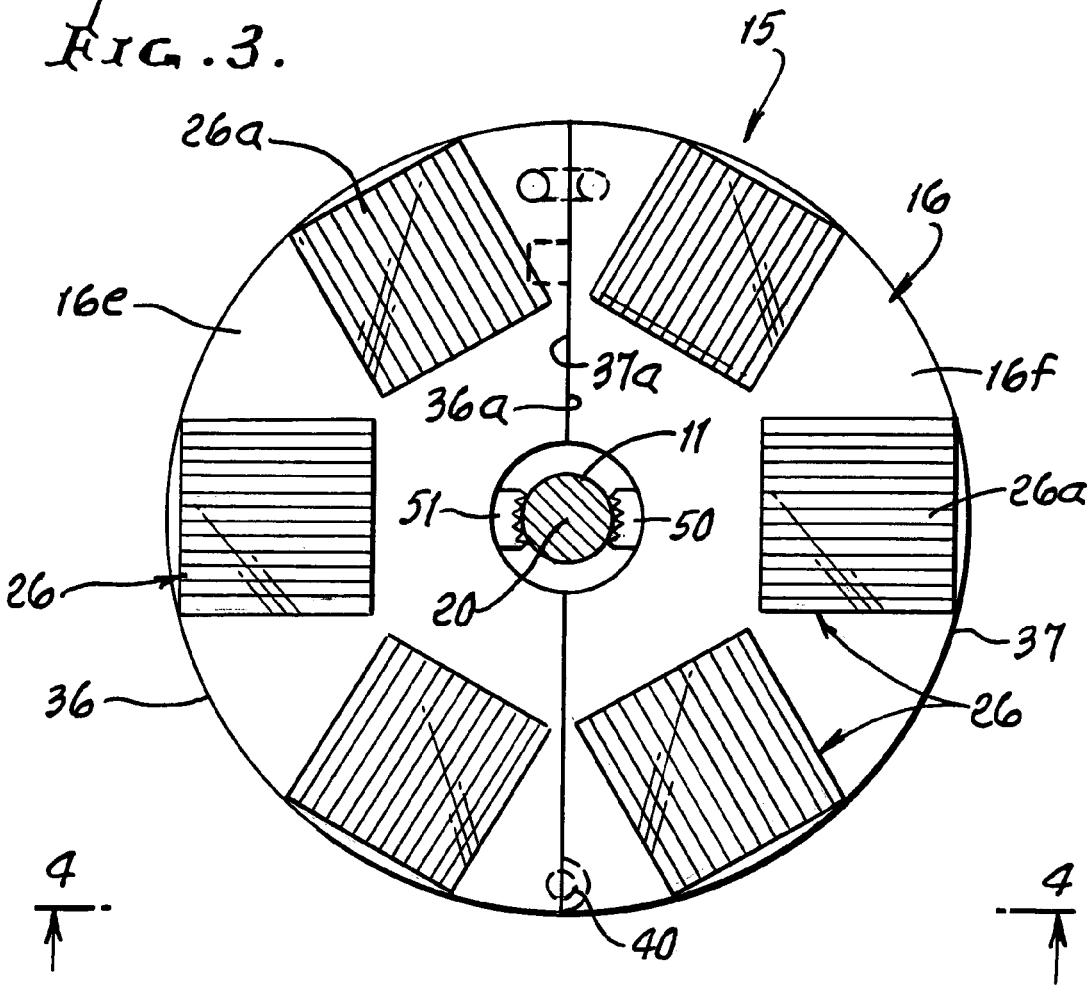
FIG. 3 is an enlarged, top plan view of the FIG. 1 apparatus.
Figure 4:
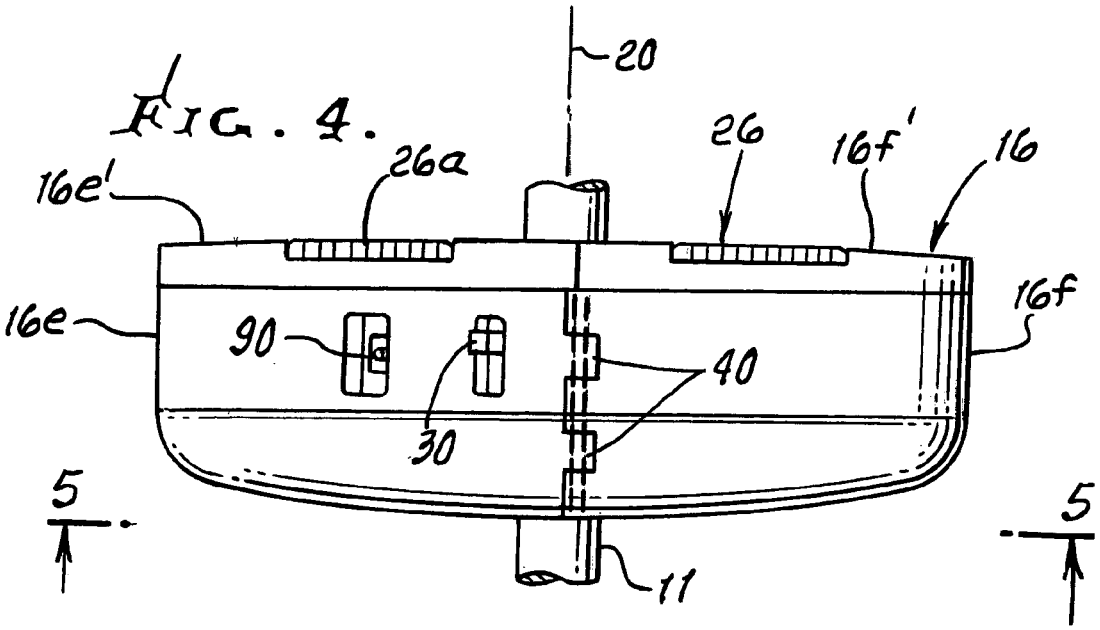
FIG. 4 is an elevation view taken on lines 4—4 of FIG. 3.

FIGS. 3 and 4 show one form of incident light responsive means on the body to provide for electrical energization of the light source or sources 18. That light responsive means is typically configured to receive incident light from a direction or directions 22*a* in FIG. 1, and 22*b* in FIG. 2, spaced away from light beams 15 and 15*b* from the source or sources. Such incident light is typically ambient daytime light. FIG. 13 shows ambient light rays 22*a* or 22*b* incident upon a solar cell or cells 26. The latter generate electricity transmitted as by circuit 27 to the LED light sources 18. A dry cell battery or batteries 29 may be incorporated in circuit 27 to store electricity generated by cell or cells 26 as during daytime; and a control switch 30 may be operated to cause circuit 27 to deliver electricity from the battery or batteries to the LEDs. Elements 18, 26, 27, and 29 are carried on, within, or by invertible body 16. As shown in FIG. 13, solar cells 26 have upwardly facing inlets 26*a*, at upper side 16*c* of body 16; and LEDs 18 generate light rays that are transmitted downwardly and away form the lower side 16*d* of body 16, as in FIG. 1. FIG. 4 shows a receptacle 90 on the body to receive AC current, to energize the LEDs, if desired.

See also FIGS. 3 and 4 showing multiple solar cells 26 spaced clockwise about the body or stand central upright axis 20; and also see FIG. 5 showing the LED clusters 18*a* and reflectors 21 spaced clockwise about the axis 20, for concentrating the LED light in beams transmitted from the reflectors.

Also shown in FIG. 13 is a remote control means 80, connected as by wiring 81 (or a radio link) with circuit 27, for controlling the intensity and/or color of light transmission from the LED or LEDS. Switch 30 enables-switching power to lights 18 from solar cell energization, to battery power energization to household AC energization.

Preferably, the body 16 is comprised of two sections, as shown at 16*e* and 16*f* in FIGS. 3–7. Those sections may have semicircular peripheries, as at 36 and 37, and flat sides 36*a* and 37*a* that interface when the body sections are closed together about the stand, as enabled by hinge connection of the bodies as at 40. When the sections are closed together, the stand becomes attached or clamped to the stand frictionally, in such manner as to allow quick release, or adjustment of the body 16 along the stand, or removal from the stand, or inverting of the body and attachment to the stand or pole as in FIG. 2.

As shown in FIGS. 5, 11 and 12, grippers 50 and 51 are carried by the body sections to grip the stand, when the sections are closed together. The grippers may have serrated edges as at 50*a* and 51*a* to frictionally grip or clamp the stand. Compression springs 52 and 53 urge the grippers toward the stand, the grippers being slidable in recesses 54 and 55 in the body sections. This also accommodates stands of different diameters, as in FIGS. 11 and 12, to which the device may be readily attached.

FIGS. 6–10 show the provision of a latch or latches 60 protruding from section 16*e* and receivable in slots 61 formed in body section 16*f*, as the two sections close together. FIG. 7 shows that latches 60 are carried on a plunger 62 movable in a guide groove or grooves 63 and 64, parallel to axis 20. When the sections are closed together, latches 60 are cammed downwardly at keeper shoulders 65 and 66, the plunger 62 then downwardly compressing a spring 67. Upon full closure of sections 16*e* and 16*f*, the latches hook into keeper recesses 68 and 69. A protruding release button 70 is manually operable upon being pushed, to move the plunger and latches downwardly, allowing their removal from recesses 68 and 69, and spreading apart of the body sections 16*e* and 16*f*, to release the carrier body from the stand. A guide protrusion 85 may be provided on section 16*f*, to fit into guide recess 86 in section 16*e* to assist in orienting the sections 16*e* and 16*f* during closure.

Body sections 16*e* and 16*f* have cover plates 16*e*' and 16*f*' which may be upwardly convex or domed.

Figure 15:
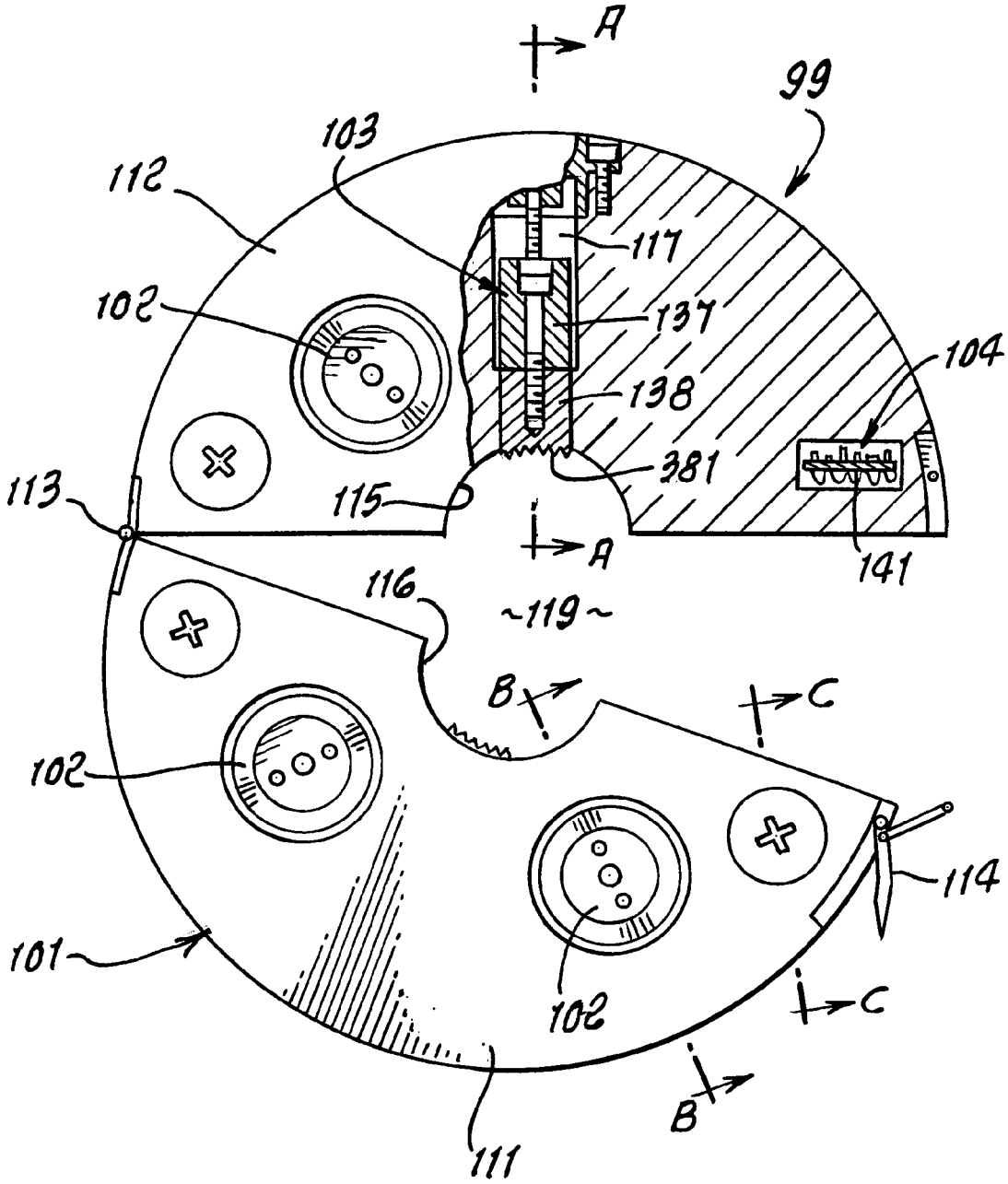
FIG. 15 is a schematic diagram of another form of the present invention.
Figure 19:
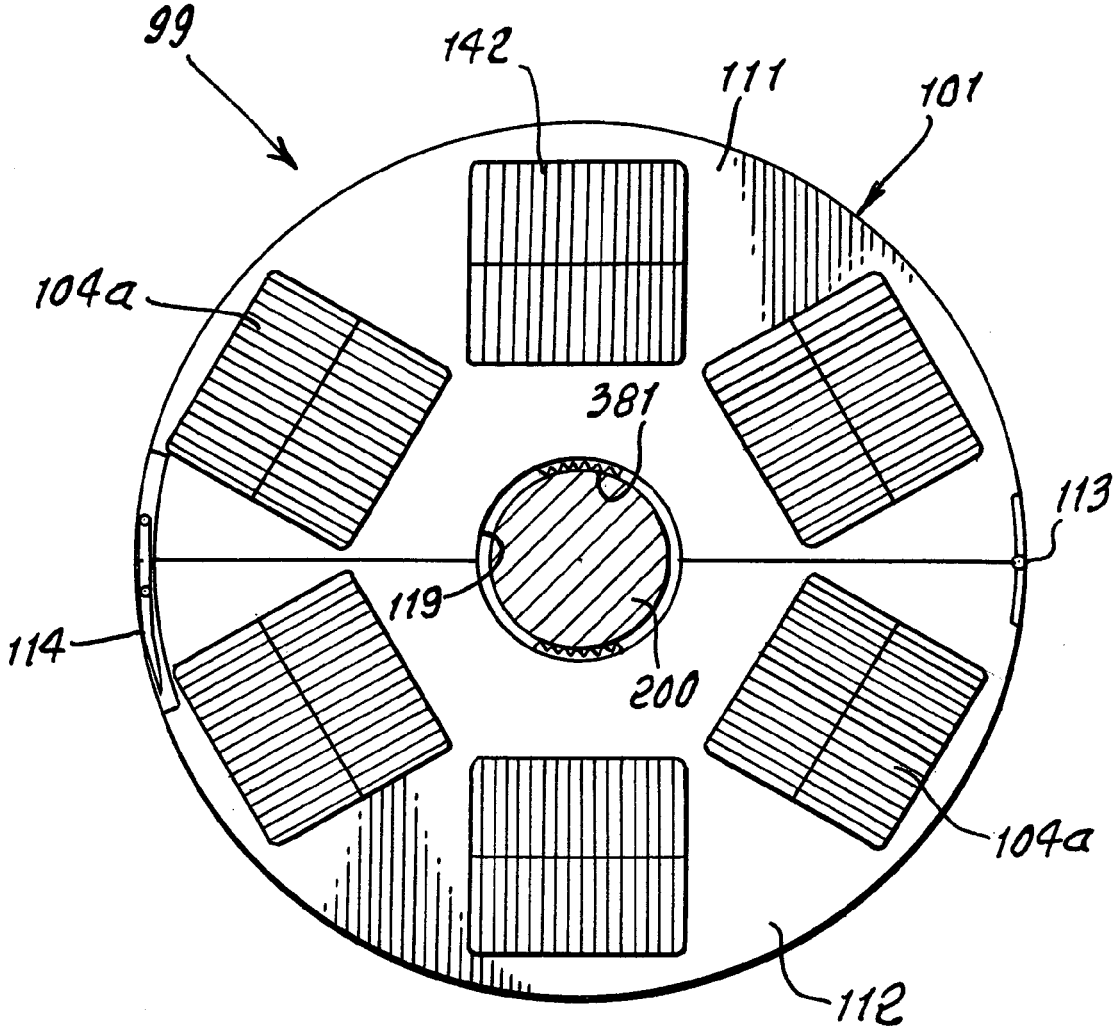
FIG. 19 shows a bottom view of a device embodying the present invention with both divided base parts A and B bound together as a whole.

As shown in FIG. 15, another form of the present invention seen at 99 comprises a base part 101, a lighting means 102, a locking means 103, and a solar power charging part 104. See also solar windows 104*a*. Furthermore, the base part 101 is preferably of circular disk shape comprising a symmetrically divided first base part 111 and a second base part 112 each having a semi-circularly curved inner sidewall surfaces 115 and 116 facing that of the other in which (when 111 and 112 are closed together) a circular through hole 119 is formed to substantially encircle a pole-like object 200 when said two base parts 111 and 112 are jointly bound together. See FIG. 19. The two base parts 111 and 112 are connected together by means of a hinge part 113 along a corner edge of each base part while the other corner edges are coupled together by means of a separable binding part 114 for ease of binding and un-binding. A perpendicular slot 117 extending inwardly through each of the inner sidewall surfaces 115 and 116, to slidably receive a locking means 103 for gripping to a pole-like object of different circumferential dimensions.

Figure 18:
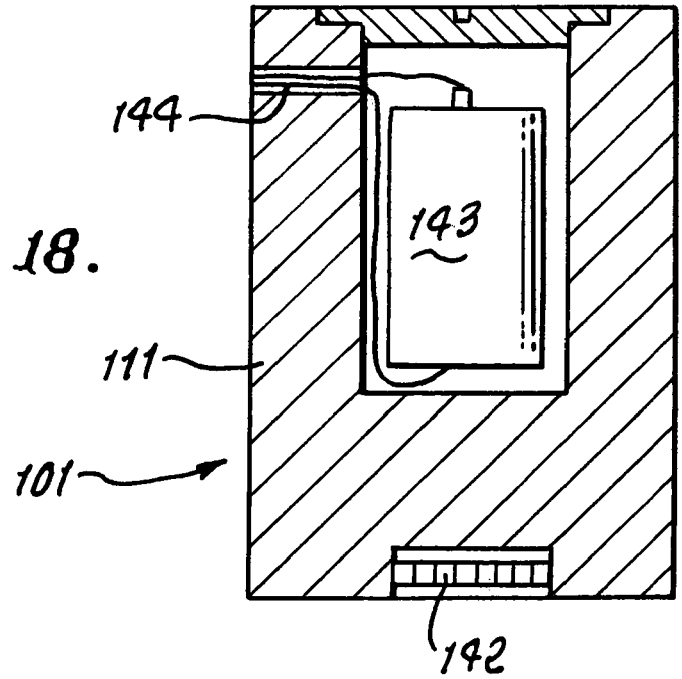
FIG. 18 shows a cross-sectional view of FIG. 15 along a C—C dissecting plane.

Preferably, the lighting means 102 of the present invention comprises a plurality of high luminance LED lamps evenly distributed on the base part 101, to which the electrical power of each LED lamps is supplied by a rechargeable battery 143 seen in FIG. 18. Each rechargeable battery 143 is concealed in a corresponding battery holder in the base part 101.

Typically, the rechargeable battery 143 is recharged with a corded charging unit. It is a feature of the present invention to use a solar power charging part 104 for charging a rechargeable battery directly. That solar power charging part 104 comprises a plurality of solar panels 142 formed on the base part 101, and each solar panel is electrically connected in series to a solar-charging circuit part 141 in the base part by means of wires 144. The solar panels 142 collect solar energy to be converted by the solar-charging circuit part 141 to electrical energy for supplying power to the rechargeable battery 143. Each solar panel 142 is inserted and bonded inside a recess 118 of the base part 101 as shown in FIG. 16.

Figure 16:
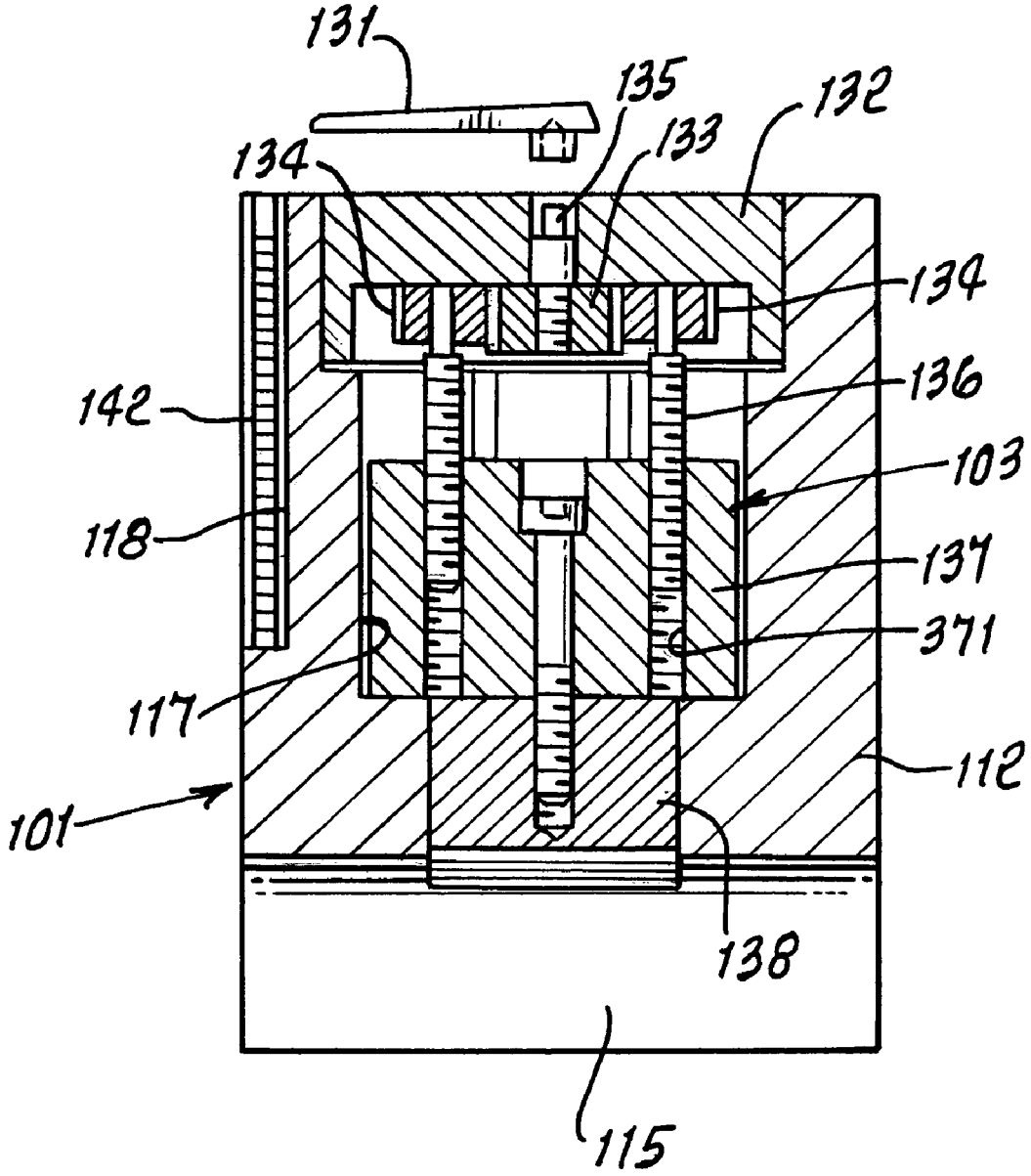
FIG. 16 shows a cross-sectional view of FIG. 15 along an A—A dissecting plane.
Figure 17:
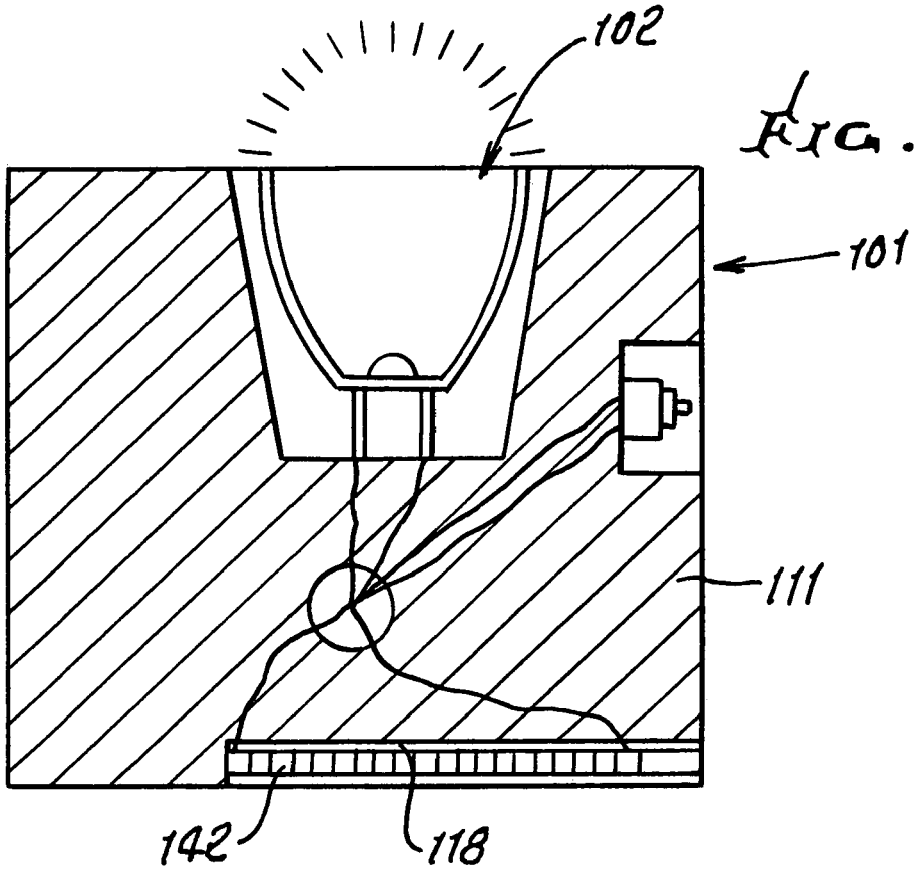
FIG. 17 shows a cross-sectional view of FIG. 15 along a B—B dissecting plane.

Referring to FIG. 16, said locking means 103 is preferably fixed inside the perpendicular slot 117 of the base part 101 for gripping to a pole-like object of different circumferential dimensions. The locking means 103 further comprises a gripping claw 138, a sliding block 137, a crank handle 131, a plurality of threaded pillar parts 136, and a transmission part. The transmission part preferably comprises a gear mounting part 132, a larger first gear 133, a pair of smaller second gears 134 both engaging said first gear 133, and an axle part 135. The gear mounting part 132 may be fixed to the base part 101 by means of screws. The first gear 133 is rotatably fixed to the gear mounting part 132 by means of the axle part 135, while the second gears 134 drive the threaded pillar part 136. An open end of the axle part 135 is coupled to the crank handle 131. The perpendicular slot 117 is integrally formed inside each of the first and second base parts 111 and 113 for slidably receiving sliding block 137. Typically, the two threaded pillar parts 136 rotatably drive sliding block 137.

Figure 21:
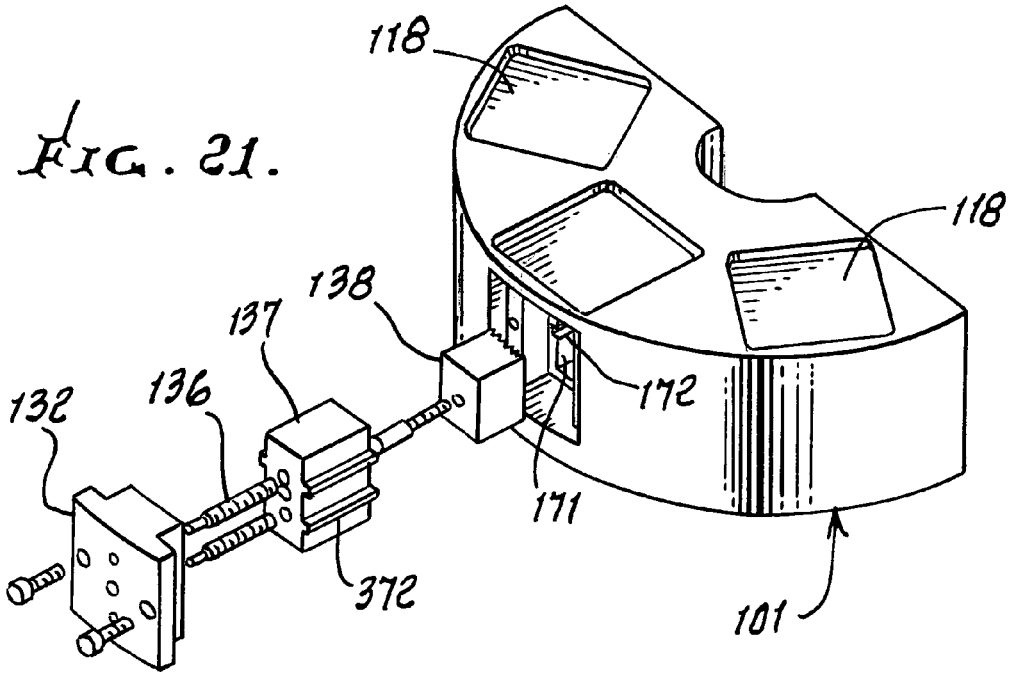
FIG. 21 shows an exploded perspective diagram of a divided base part of the present invention.

As seen in FIG. 21, a longitudinal extending recessing strip 172 formed on each side wall 171 of the perpendicular slot 117 slidably receives a corresponding longitudinal extending protruding rail 372 formed on each side wall of the sliding block 137. Sliding block 137 further comprises a plurality of threaded through holes 371 (see FIG. 16) which preferably are two in number in this embodiment. Each threaded through hole 371 receives a threaded pillar part 136 by means of such thread. Second gears 134 enable inward or outward sliding movements of the sliding block 137 along the longitudinal direction of the perpendicular slot 117 through rotation of the threaded pillar parts 136. The gripping claw 138 is securely coupled to the sliding block 137 by means of screws. Typically, the sliding block 137 and the gripping claw 138 are both of rectangular shape.

A concavely curved gripping surface is formed on the gripping claw 138 such that a curved gripping teeth profile 381 is preferably formed on the curved gripping surface. The gripping claw 148 is securely coupled to the sliding block 137 which slides along the longitudinal direction of 117 which extends normal to the device axis. Thus, gripping tension of said gripping claw can be suitably adjusted when gripping to a pole-like object by suitably adjusting the extension of said gripping claw 148 protruding from the perpendicular slot 117 of said coupling surface.

Figure 20:
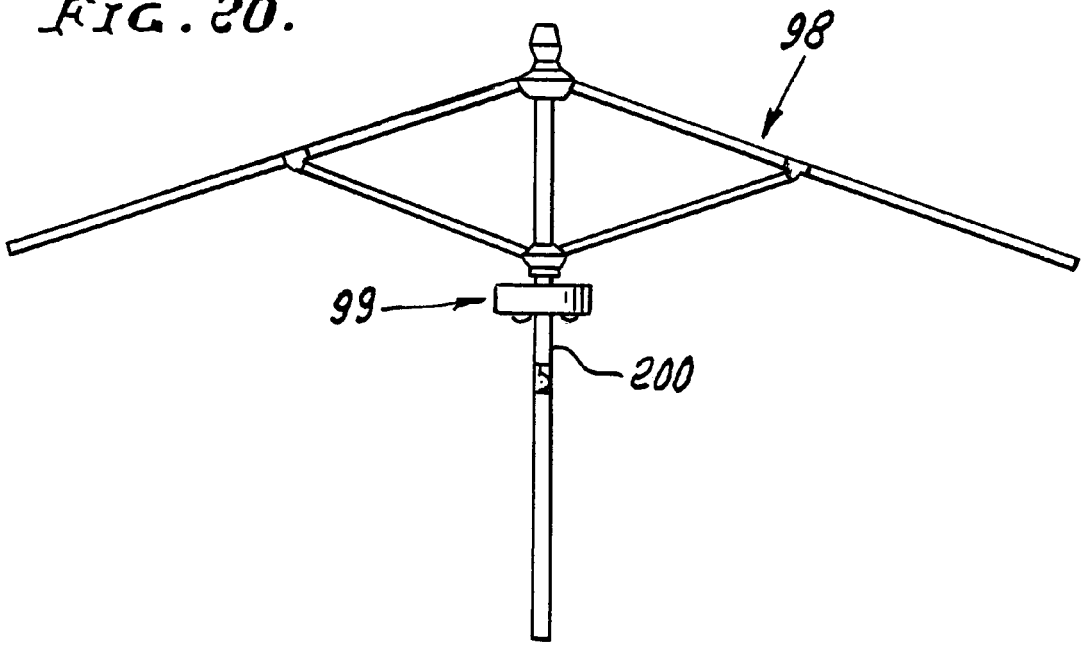
FIG. 20 is a frontal view showing schematically the application of a device embodying the present invention to or on umbrella structure.
Figure 22:
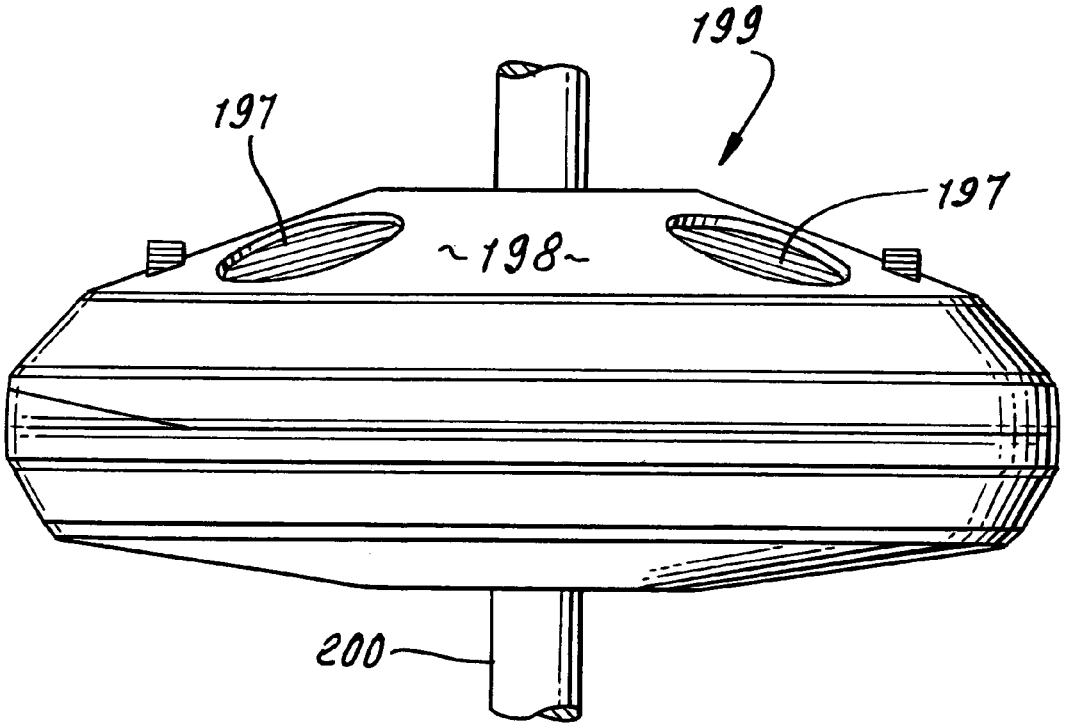
FIG. 22 is a side elevation view of a modified device.

FIG. 20 shows the device 99 attached to stand 200 supporting umbrella 98. FIG. 22 shows a modified device 199, like 99, but upwardly domed at 198 so that light receiving windows 197 are angled to efficiently receive light from under the edges of the umbrella.

Although the present invention has been explained by the embodiments shown in the drawings described above, it should be understood to the ordinary skilled person the art that the invention is not limited to the embodiments, but rather that various changes or modifications thereof are possible without departing from the spirit of the invention. Accordingly, the scope of the invention shall be determined only by the appended claims and their equivalents.

I claim:

1. A light for an umbrella pole, comprising in combination:

a) a body comprising an inner surface and a clamping device comprising a gripping surface and a spring located between the inner surface and the gripping surface, the spring configured to resiliently urge the gripping surface into engagement with the umbrella pole, whereby the body is releasably attachable to the umbrella pole, b) a source or sources of electric light carried by the body, to direct said light away from the body, c) and incident light responsive means on the body to provide electrical energization for said light source, said means configured to receive incident light from a direction or directions spaced away front light directed from said source or sources.

2. The light claim 1 wherein said body includes multiple sections that become interconnected when said body is attached to the umbrella pole.

3. The light of claim 2 wherein at least two or said sections have hinged interconnection, whereby said sections are clampingly connectable to the umbrella pole.

4. The light of claim 1 wherein said body has upper and lower sides, said means is located to face away from one of said sides, and said source of electric light is located to race away from the other of said sides.

5. The light of claim 4 wherein said means comprise a solar cell or cells, and said light source or sources comprise an LED or LEDs.

6. The light of claim 4 wherein said one side is generally convex in one direction away from the body, and said other side is generally convex in an opposite direction away from the body.

7. The light of claim 1 wherein said body defines a through opening to receive the umbrella pole.

8. The light of claim 7 wherein said opening has at least two selectable sizes to receive poles of different diameters.

9. The light of claim 7 wherein said means comprise solar cells spaced about said through opening, and said light sources comprise LEDs spaced about said central opening, in light concentrating clusters, each cluster received in a light reflecting receptacle.

10. The light of claim 1 including a control to control at least one of the intensity and color of light emission from said source or sources.

11. The light of claim 5 including at least one control to control at least one of the intensity and color of light emission from said LED or LEDs.

12. The light of claim 7 including a pole gripper or grippers at said opening and carried by the body.

13. The light of claim 12 wherein the body includes two sections respectively carrying said grippers, there being a spring or springs urging at least one gripper relatively toward another gripper.

14. The light of claim 3 including latch elements carried by said body sections to latch together when the sections are closed about an umbrella pole.

15. The light of claim 14 including a latch release on at least one of the sections and movable to unlatch said latch elements, there being a guide means to guide the sections when closed about the pole.

16. A lighting device suitable for fastening to a pole-like object, comprising:

a) a base part, b) and a light source;

c) wherein, the base part comprises a first base part and a second base part pivotably coupled with the first base part, said first and second base parts being divided so that each has an inner sidewall surface facing that of the other, said sidewall surfaces forming a through hole to substantially encircle the pole-like object when said two base parts are connected, said sidewall surfaces having at least one recess formed therein, said base part having a clamp comprising a gripping surface and a resilient member at least partially located in the recess, the gripping surface being movable relative to the sidewall surface between an extended position and a range of clamping positions, the clamping positions being between the extended position and the sidewall surface, the resilient member configured to urge the gripping surface toward the extended position, whereby the lighting device can be self-supported on umbrella poles of different sizes.

17. The lighting device of claim 16, wherein the gripping surface is a first gripping surface and the clamp further comprises:

a first member extending from a recess in the inner sidewall surface of the first base part, the first member comprising said first gripping surface; and a second gripping surface generally opposing said first gripping surface;

the clamp configured to urge the gripping surfaces into frictional engagement with the pole-like object.

18. The lighting device of claim 17, further comprising a second member comprising said second gripping surface, the second member extending from a recess in the inner sidewall surface of the second base part.

19. The lighting device of claim 17, wherein at least one of said gripping surfaces comprises a serrated edge to enhance friction between the serrated edge and the pole-like object.

20. The lighting device of claim 16, further comprising a hinge adjacent a first end of each of said first base part and said second base part, said hinge coupling said first ends of said first and second base parts together.

21. The lighting device of claim 20, further comprising a latch adjacent a second end of said first and second base parts, said latch configured to connect said first and second base parts.

22. The lighting device of claim 16, wherein the base part includes a recess and the clamp further comprises:

a first member comprising a sliding block slidable within the recess and a first engagement surface;

a plurality of threaded pillar parts configured to drive the sliding block;

a transmission transmitting longitudinal force to the sliding block via rotation of the threaded pillar parts; and a crank handle configured to cause the pillar parts to rotate whereby the first engagement surface is urged into engagement with the pole-like object.

23. The lighting device of 22, wherein the transmission further comprises:

a drive gear coupled with the crank handle; and a pair of driven gears coupled with the drive gear and with the pillar parts;

wherein rotation of the crank handle induces rotation in the pillar parts to slide the sliding block.

24. The lighting device of claim 16, wherein the lighting device further comprises a solar power charging unit.

25. The lighting device of claim 24, wherein the solar power charging unit further comprises:

a plurality of solar panels located on the base part;

a plurality of wires; and a solar-charging circuit, wherein, each solar panel is electrically connected in series to the solar-charging circuit in the base part by said wires.

26. The lighting device of claim 16 wherein the base part has a generally circular, disk shape, and further comprising:

a symmetrically divided first base part and a second base part each having a semi-circularly curved inner sidewall surface facing that of the other in which a circular through hole is formed to substantially encircle the pole-like object when said two base parts are locked together; and a clamp to lock said two base parts together.

27. The lighting device of claim 16, wherein the base part further comprises:

a hinge; and a latch;

wherein the first and second base parts are held together by the hinge along a corner edge of each of said first and second base parts while the other corner edges are releasably coupled together by the latch.

28. The lighting device of claim 16, wherein the light source comprises LED lamps.

29. The lighting device of claim 28, wherein the light source comprises a rechargeable battery supplying electricity to the LED lamps.

30. The lighting device of claim 16, further comprising a solar panel and a battery configured to be recharged by said solar panel, said solar panel and said battery providing energy to the light source.

31. The lighting device of claim 16, further comprising a battery coupled with the light source to provide energy to the light source.

32. The lighting device of claim 31, wherein the battery is a rechargeable battery and further comprising a corded charging unit.

33. A light for an umbrella pole, comprising in combination:

a) a body comprising an inner sidewall surface at least partially defining an opening for receiving an umbrella pole, b) a clamping device comprising a gripping surface and a resilient member located between the gripping surface and the inner sidewall surface, at least a portion of the clamping device being movable relative to the sidewall surface between an extended position and a range of clamping positions, the clamping positions being located between the extended position and the sidewall surface, the resilient member urging the gripping surface toward the extended position, whereby the light can be self-supported on umbrella poles of different sizes, c) a source or sources of electric light carried by the body, to direct said light away from the body, d) and means on or in the body for providing energy to said light source.

34. The light of claim 33, wherein the means for providing energy comprises at least one solar panel.

35. The light of claim 34, wherein the means for providing energy comprises a battery configured to be recharged by said at least one solar panel.

36. The light of claim 33, wherein the means for providing energy comprises a battery.

37. The light of claim 36, wherein the battery is a rechargeable battery and further comprising a corded charging unit.

38. The light of claim 33 including at least one stand gripper carried by the body at said opening.

39. The light of claim 38, wherein the body includes two sections carrying said grippers, there being at least one spring urging at least one gripper relatively toward another gripper.

40. The light of claim 38, including means for adjusting said at least one gripper.

41. A light for mounting around a pole, comprising:

a clamshell housing having an outer periphery and comprising a first portion and a second portion pivotably coupled to the first portion adjacent a location on the outer periphery, the first portion having a first inner sidewall surface and a first lateral surface extending outwardly from the inner sidewall surface to the outer periphery of the clamshell housing, the second portion having a second inner sidewall surface and a second lateral surface extending outwardly from the inner sidewall surface to the outer periphery of the clamshell housing, the first and second portions defining an opening configured to receive the pole having a longitudinal axis;

at least one light source and power supply for the light source(s) carried by the clamshell housing, the housing having one or more opening(s) by means of which the light source(s) direct light away from at least one of the first and second lateral surfaces;

at least one clamp for engaging in use, the pole in a direction substantially perpendicular to the axis of the pole, the clamp extending in said direction from at least one of the inner sidewall surfaces and being spring-biased in said direction;

the first and second portions being connectable together adjacent the opening between them, to cause the clamp to grip the pole so that the light is self supported thereon; and the clamp being biased to be able to engage poles of different diameters and to be mountable at various locations along the pole.

42. The light of claim 41, wherein the light source(s) are located between the outer periphery and the opening.

43. The light of claim 41, wherein the light source(s) are recessed in the housing.

44. The light of claim 41, wherein light from the light source(s) can be directed upward toward an umbrella mounted on the pole or downward away from the umbrella.

* * * * *

UNITED STATES PATENT AND TRADEMARK OFFICE

CERTIFICATE OF CORRECTION

PATENT NO. : 7,134,762 B2
APPLICATION NO. : 10/715096
DATED : November 14, 2006
INVENTOR(S) : Oliver Joen-An Ma It is certified that error appears in the above-identified patent and that said Letters Patent is hereby corrected as shown below:

At column 4, line 54, please delete “enables-switching” and insert --enables switching--.

At column 7, line 6, please delete “front” and insert --from--.

At column 7, line 8, after “light” please insert --of--

At column 7, line 11, please delete “or” and insert --of--.

At column 7, line 16, please delete “race” and insert --face--.

At column 10, line 40, please delete “self supported” and insert --self-supported--.

Signed and Sealed this

Twenty-second Day of July, 2008

JON W. DUDAS
*Director of the United States Patent and Trademark Office*